US009393567B2

(12) United States Patent
Biggin

(10) Patent No.: US 9,393,567 B2
(45) Date of Patent: Jul. 19, 2016

(54) SYSTEM AND METHOD FOR HYDRAULICALLY REMOVING A SOCKET FROM A MAINSHAFT OF A GYRATIONAL CRUSHER

(71) Applicant: Metso Minerals Industries, Inc., Waukesha, WI (US)

(72) Inventor: David Francis Biggin, Burlington, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 317 days.

(21) Appl. No.: 14/164,635

(22) Filed: Jan. 27, 2014

(65) Prior Publication Data

US 2015/0209791 A1 Jul. 30, 2015

(51) Int. Cl.
*B02C 2/04* (2006.01)
*B02C 2/02* (2006.01)

(52) U.S. Cl.
CPC ... *B02C 2/04* (2013.01); *B02C 2/02* (2013.01); *Y10T 29/53683* (2015.01)

(58) Field of Classification Search
CPC ..... B02C 2/02; B02C 2/04
USPC ..... 241/207–216
See application file for complete search history.

(56) References Cited

U.S. PATENT DOCUMENTS

| | | | | |
|---|---|---|---|---|
| 3,107,063 | A * | 10/1963 | Nyberg | B02C 19/08 241/212 |
| 3,837,585 | A | 9/1974 | Decker et al. | |
| 4,027,825 | A | 6/1977 | Coxhill | |
| 4,198,003 | A | 4/1980 | Polzin et al. | |
| 4,681,269 | A | 7/1987 | Arakawa | |
| 5,163,213 | A | 11/1992 | Brizendine | |
| 5,602,945 | A | 2/1997 | Davis | |
| 5,725,163 | A | 3/1998 | Eloranta et al. | |
| 5,996,915 | A * | 12/1999 | Cordonnier | B02C 2/047 241/207 |
| 5,996,916 | A | 12/1999 | Musil | |
| 6,000,648 | A | 12/1999 | Ambrose | |
| 6,536,693 | B2 | 3/2003 | Van Mullem et al. | |
| 8,033,491 | B2 | 10/2011 | Solomon et al. | |
| 8,215,576 | B2 | 7/2012 | Martinez, Jr. et al. | |
| 2008/0272218 | A1 * | 11/2008 | Niklewski | B02C 2/047 241/208 |
| 2011/0006143 | A1 * | 1/2011 | Gunnarsson | B02C 2/04 241/215 |

FOREIGN PATENT DOCUMENTS

| | | | |
|---|---|---|---|
| GB | 1 541 159 | A | 2/1979 |
| WO | 2010105323 | A1 | 9/2010 |
| WO | 2013052754 | A1 | 4/2013 |

OTHER PUBLICATIONS

PCT International Search Report mailed Feb. 17, 2015.

* cited by examiner

*Primary Examiner* — Faye Francis
(74) *Attorney, Agent, or Firm* — Andrus Intellectual Property Law, LLP

(57) ABSTRACT

A hydraulic separation system for use in a gyrational crusher to separate a socket of the crusher from a main shaft. The hydraulic separation system includes one or more hydraulic grooves formed at the interference contact area between the socket and the main shaft. Each hydraulic groove is fed with a supply of pressurized hydraulic fluid to aid in separation of the socket from the main shaft. An inner contact surface of the socket is tapered and engages a tapered outer surface of the main shaft. The mating tapered surfaces further aid in separation of the socket from the main shaft upon application of the pressurized hydraulic fluid.

19 Claims, 10 Drawing Sheets

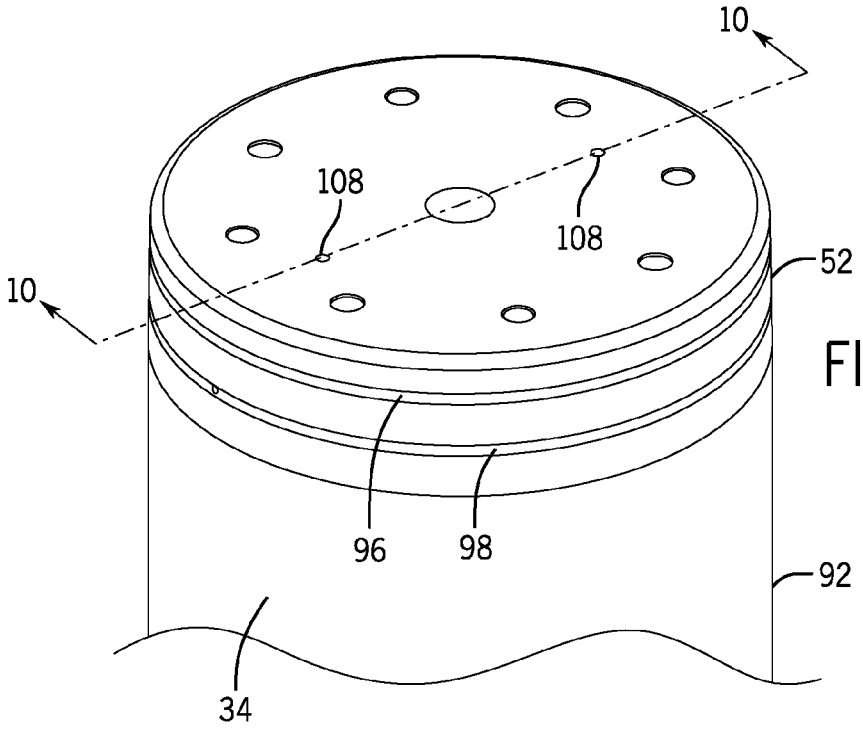
FIG. 9
FIG. 10
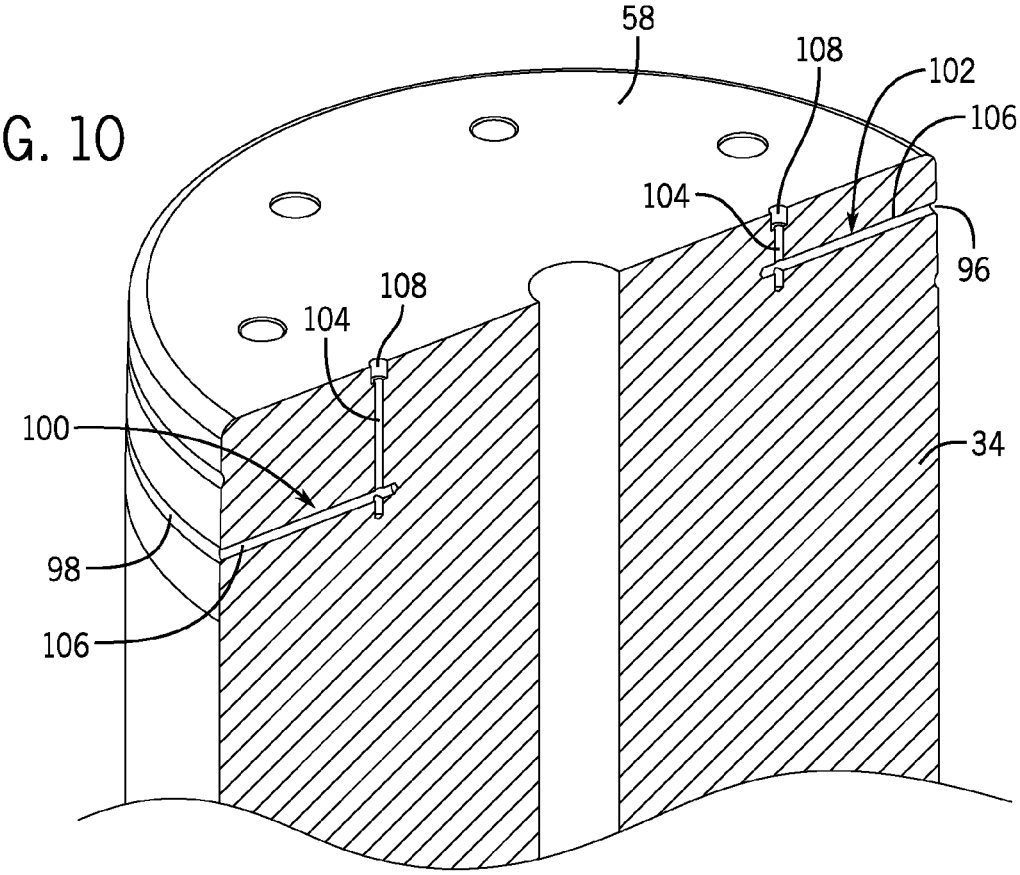

SYSTEM AND METHOD FOR HYDRAULICALLY REMOVING A SOCKET FROM A MAINSHAFT OF A GYRATIONAL CRUSHER

BACKGROUND

The present disclosure generally relates to gyratory rock crushing equipment. More specifically, the present disclosure relates to a system and method for hydraulically removing a socket from the main shaft of a cone crusher.

Rock crushing systems, such as those referred to as cone crushers, generally break apart rock, stones or other material in a crushing gap between a stationary element and a moving element. For example, a conical rock crusher is comprised of a head assembly including a crushing head that gyrates about a vertical axis within a stationary bowl positioned within the mainframe of the rock crusher. The crushing head is assembled surrounding an eccentric that rotates about a fixed main shaft to impart the gyrational motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The crushing head of large cone crushers is rotationally supported upon a stationary main shaft. The stationary main shaft includes a socket that is securely attached to the main shaft. The socket has a heavy interference fit with the main shaft which is necessary for the socket to stay assembled to the main shaft while crushing to prevent motion between these two components. Presently, when the cone crusher is disassembled for maintenance, the socket must be removed from the top end of the main shaft. Typically, during the removal process, the socket is heated, which causes the socket to thermally expand relative to the main shaft, which temporarily creates clearance between the two components in the fit area. Once the socket has been heated, jack screws are used to push the socket off the main shaft and an overhead crane is used to completely remove the socket from the main shaft.

Problems exist with the current method of heating the socket and utilizing jack screws to separate the socket from the main shaft. These problems include the relatively large amount of labor and time required to heat the socket and quickly utilize jack screws to move the socket relative to the main shaft. Specifically, if the socket is not removed quickly enough, the heat from the socket is transferred to the main shaft, which causes the main shaft to expand and the clearance between the socket and the main shaft necessary for disassembly using the jacking screws no longer exists. When this happens, the main shaft and socket must be allowed to cool and the process is repeated. Further, during this removal process, the socket can drag along the main shaft, which causes the contact surface to become scored, thus decreasing the effective life of both the socket and the main shaft. The removal process described above requires experienced personnel and a significant amount of time to remove the socket without damaging either the socket or the main shaft.

Since the socket needs to be removed each time the eccentric is disassembled from the crusher, any improvement in the socket disassembly process would be useful in reducing the amount of time and experience needed during the maintenance process.

SUMMARY

The present disclosure relates to a hydraulic removal system for use with a cone crusher. The hydraulic removal system aids in removing a socket from the main shaft of a cone crusher.

The cone crusher includes a stationary bowl and a head assembly that is movable within the stationary bowl to create a crushing gap between the stationary bowl and the head assembly. A main shaft, having a top end and an outer surface, is positioned such that the head assembly rotates relative to the main shaft. Specifically, an eccentric is rotatable about the main shaft to impart gyrational movement to the head assembly within the stationary bowl.

The cone crusher further includes a socket that is mounted to the top end of the main shaft. The socket typically supports a socket liner, which in turn receives a head ball of the head assembly to support the gyrational movement of the head assembly. The socket is securely attached to a top end of the main shaft through interference fit and a series of connectors.

The gyrational crusher of the present disclosure includes a hydraulic separation system that is operable to aid in separating the socket from the top end of the main shaft, such as during maintenance of the gyrational crusher. The hydraulic separation system utilizes a supply of pressurized hydraulic fluid to create separation between the socket and the outer surface of the main shaft.

In one embodiment of the disclosure, the hydraulic separation system includes one or more hydraulic grooves formed between the main shaft and the socket. In addition to the hydraulic grooves, the hydraulic separation system can include tapered contact surfaces formed on both the inner contact surface of the socket and the outer surface of the main shaft. The use of both the tapered contact surfaces and the hydraulic grooves allows a supply of pressurized hydraulic fluid to aid in separating the socket from the main shaft.

In one embodiment of the disclosure, one or more hydraulic grooves are formed along the inner contact surface of the socket. Each of the hydraulic grooves is in fluid communication with a hydraulic supply passageway formed in an outer wall of the socket. Pressurized hydraulic fluid passes through the annular wall of the socket to supply the pressurized hydraulic fluid to the hydraulic grooves.

In a second, alternate embodiment, the outer surface of the main shaft includes one or more hydraulic grooves. Each of the hydraulic grooves is in fluid communication with a hydraulic supply passageway that extends through the main shaft from a top surface of the main shaft. Pressurized hydraulic fluid flows through each of the hydraulic supply passageways and into the hydraulic groove.

In yet another alternate embodiment, the hydraulic separation system includes one or more hydraulic grooves formed along the inner contact surface of the socket while the hydraulic supply passageways are formed within the main shaft. When the socket is installed onto the main shaft, the hydraulic supply passageways formed in the main shaft are in fluid communication with the hydraulic grooves formed in the socket. In this manner, pressurized hydraulic fluid can pass through the main shaft and into the hydraulic grooves formed in the socket to create separation between the socket and the main shaft.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 7(*b*) is a magnified, partial section view of the main shaft showing the tapered outer surface;

FIG. 9 is a partial isometric view illustrating the top end of a second embodiment of the main shaft:

FIG. 10 is a section view taken along line 10-10 of FIG. 9;

DETAILED DESCRIPTION

Figure 1:
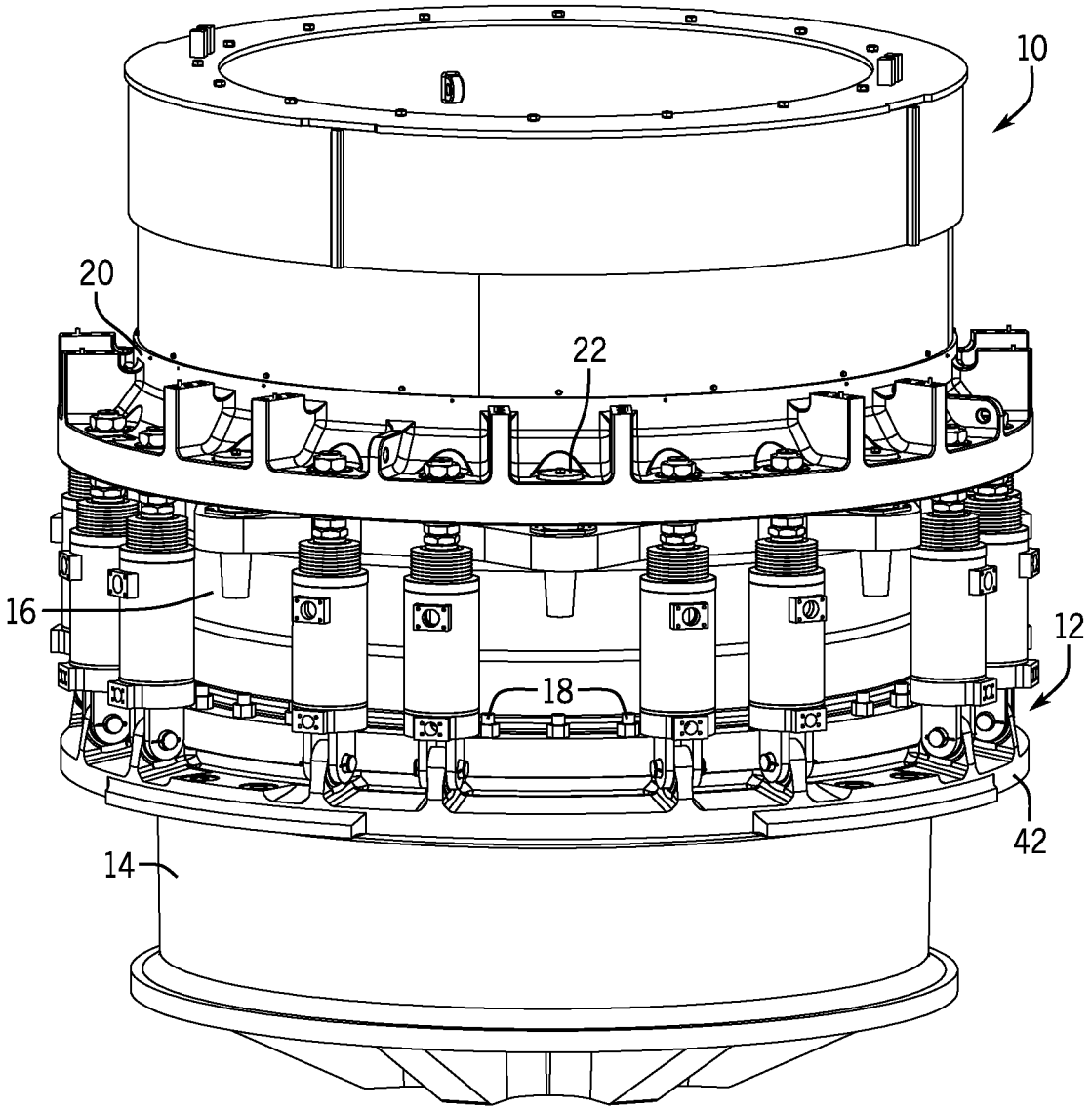
FIG. 1 is an isometric view of a cone crusher incorporating a hydraulic removal system for removing a socket from a main shaft of the cone crusher.

FIG. 1 illustrates a gyrational crusher, such as a cone crusher 10, that is operable to crush material, such as rock, stone, ore, mineral or other substances. The cone crusher 10 shown in FIG. 1 is of sufficiently large size such that the mainframe 12 is split into two separate pieces based upon both manufacturing and transportation limitations. The mainframe 12 includes a lower mainframe 14 and an upper mainframe 16 that are joined to each other by a series of fasteners 18. The upper mainframe 16 receives and supports an adjustment ring 20. As illustrated in FIG. 1, a series of pins 22 are used to align the adjustment ring 20 relative to the upper mainframe 16 and prevent rotation therebetween.

Figure 2:
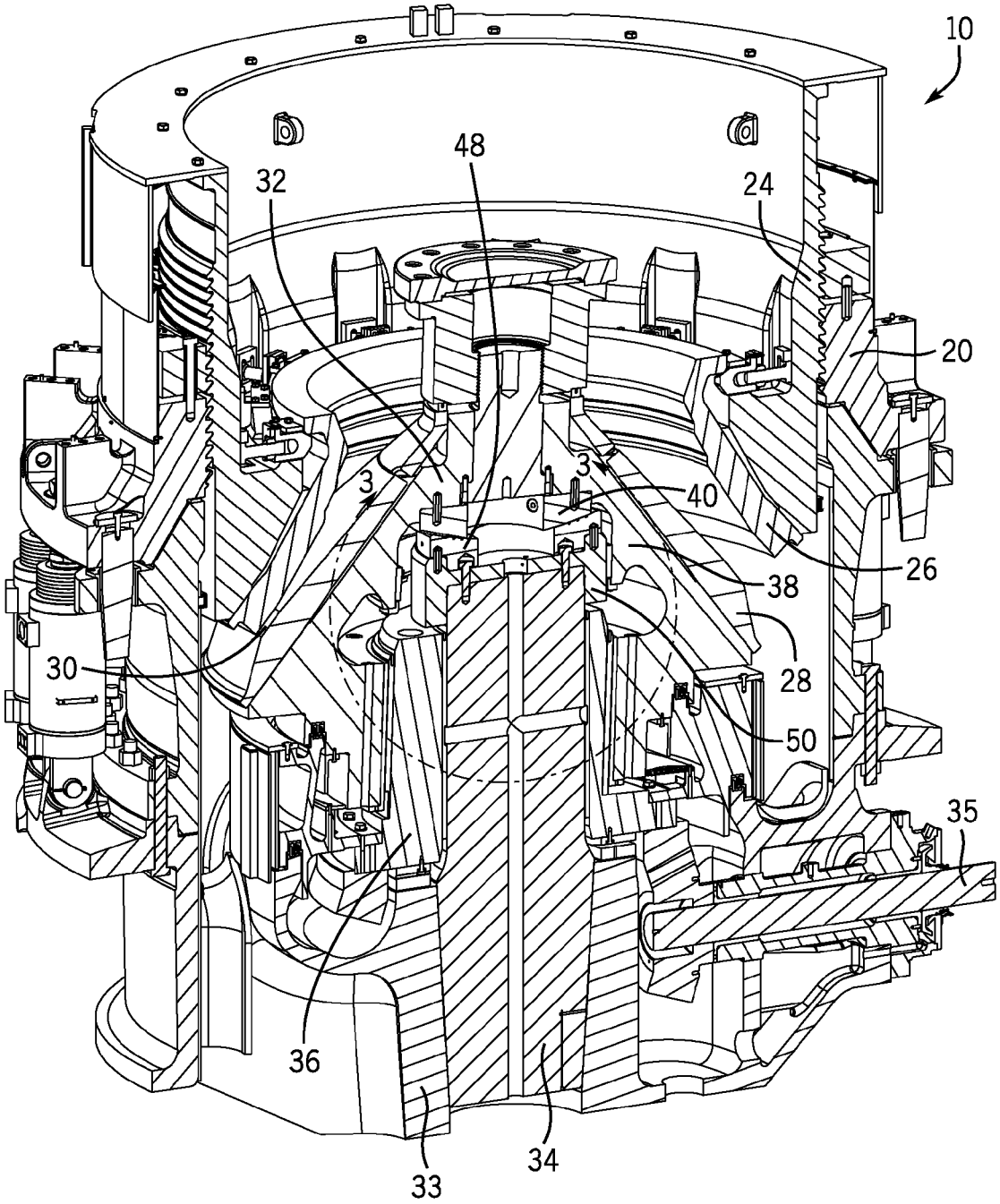
FIG. 2 is a section view of the cone crusher shown in FIG. 1.

Referring now to FIG. 2, the adjustment ring 20 receives and partially supports a bowl 24 which in turn supports a bowl liner 26. The bowl liner 26 combines with a mantle 28 to define a crushing gap 30. Mantle 28 is mounted to a head assembly 32 that is supported on a main shaft 34. The main shaft 34, in turn, is connected to a mainframe hub 33 that is connected to the outer barrel (cylinder) of the mainframe. An eccentric 36 rotates about the stationary main shaft 34, thereby causing the head assembly 32 to gyrate within the cone crusher 10. Gyration of the head assembly 32 within the stationary bowl 24 supported by the adjustment ring 20 allows rock, stone, ore, minerals or other materials to be crushed between the mantle 28 and the bowl liner 26.

As can be understood in FIG. 2, when the cone crusher 10 is operating, a driven counter shaft 35 rotates the eccentric 36. Since the outer diameter of the eccentric 36 is offset from the inner diameter, the rotation of the eccentric 36 creates the gyrational movement of the head assembly 32 within the stationary bowl 24. The gyrational movement of the head assembly 32 changes the size of the crushing gap 30 which allows the material to be crushed to enter into the crushing gap. Further rotation of the eccentric 36 creates the crushing force within the crushing gap 30 to reduce the size of particles being crushed by the cone crusher 10. The cone crusher 10 may be one of many different types of cone crushers available from various manufacturers, such as Metso Minerals of Waukesha, Wis. An example of the cone crusher 10 shown in FIG. 1 can be an MP® Series rock crusher, such as the MP 2500 available from Metso Minerals. However, different types of cone crushers could be utilized while operating within the scope of the present disclosure.

Figure 3:
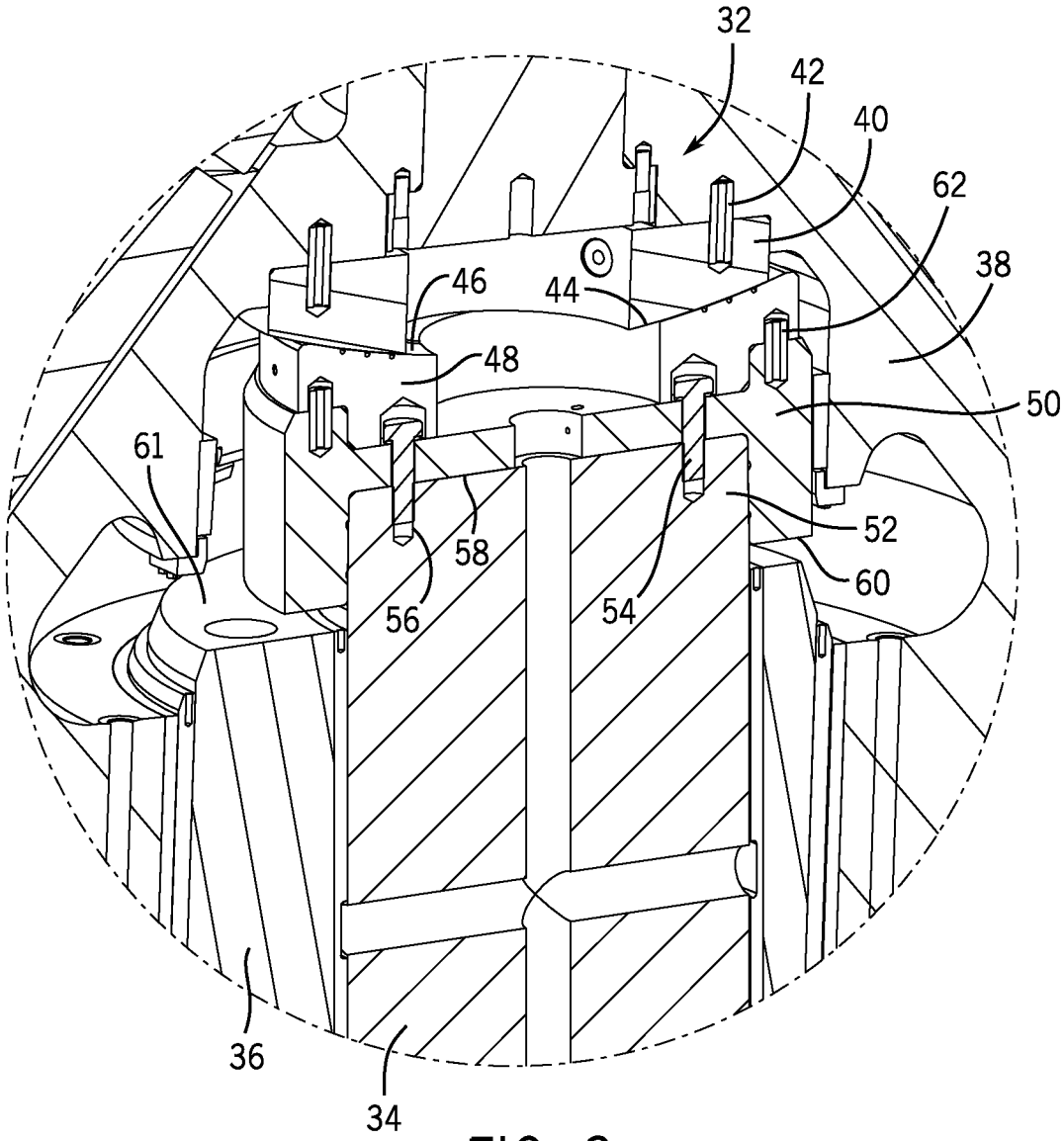
FIG. 3 is a magnified view taken along line 3-3 of FIG. 2 illustrating the interaction between a socket and the top end of the main shaft.

As illustrated in FIGS. 2 and 3, the head assembly 32 includes a head 38 that is securely attached to a head ball 40 by a series of connecting pins 42. The head ball 40 has a spherical lower surface 44 that contacts a dished upper surface 46 of a socket liner 48. The interaction between the head ball 40 and the socket liner 48 facilitates the gyrational movement of the head assembly 32.

The socket liner 48, in turn, is mounted to and supported by a socket 50. The socket 50 is securely attached to a top end 52 of the main shaft 34 by a series of connectors 54 that are each received within a threaded bore 56 extending into the main shaft 34 from the top surface 58. As best shown in FIG. 3, an annular bottom surface 60 of the socket 50 is spaced above top end 61 of the eccentric 36. The socket 50 is secured to the socket liner 48 through a series of pins 62 which prevent relative rotational movement between the socket liner 48 and the socket 50.

Figure 5:
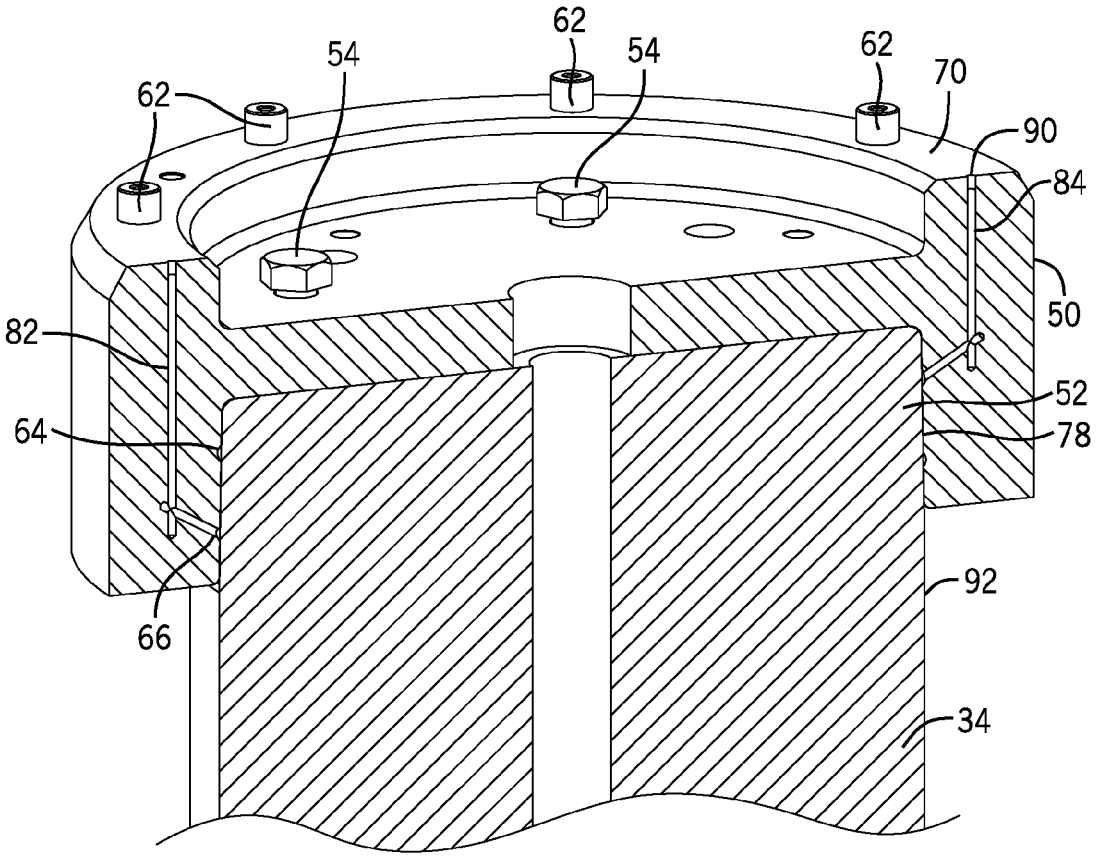
FIG. 5 is a section view of the socket mounted to the top end of the main shaft.

FIG. 5 illustrates the series of spaced connectors 54 that are used to attach the socket 50 to the top end 52 of the main shaft 34, as well as the series of spaced pins 62 that are used to prevent rotational movement between the socket 50 and the socket liner 48 (not shown).

During maintenance of the cone crusher 10, the socket 50 must be removed from the top end 52 of the main shaft 34 before the eccentric 36 can be removed, as can be understood in FIG. 3. In prior cone crushing systems, the socket 50 is heated to cause the expansion of the metallic material used to form the socket. The expansion of the socket 50 was utilized along with a series of jack screws to lift the socket 50 from the top end 52 of the main shaft 34. In accordance with the present disclosure, a hydraulic separation system is utilized to separate the socket 50 from the top end 52 of the main shaft 34.

Figure 4:
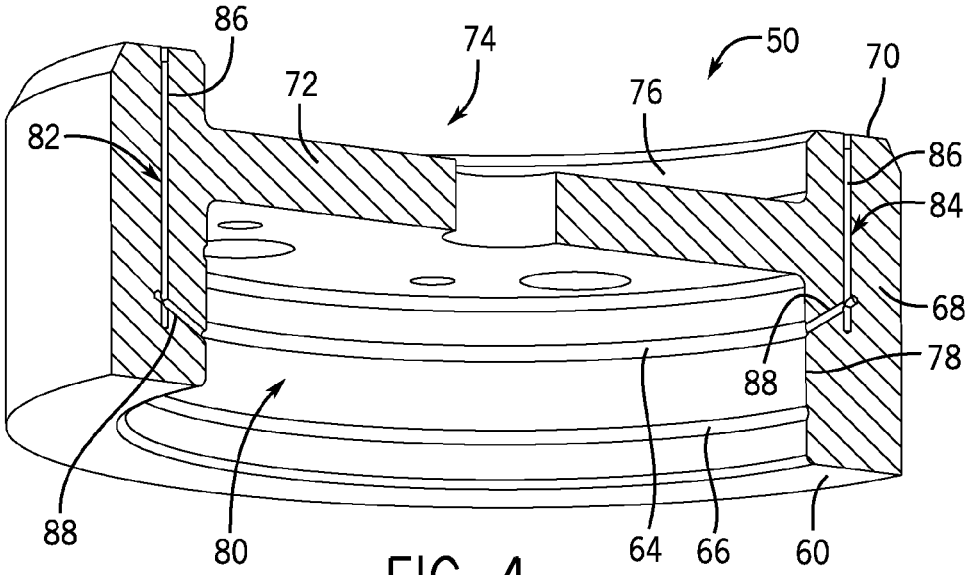
FIG. 4 is a section view of a first embodiment of the socket.

In accordance with the present disclosure, the socket 50, shown in FIG. 4, is machined to include one or more hydraulic grooves. In the embodiment shown in FIG. 4, the socket 50 includes an upper hydraulic groove 64 and a lower hydraulic groove 66. Although upper and lower hydraulic grooves 64, 66 are shown in the embodiment of FIG. 4, it should be understood that the pair of hydraulic grooves could be replaced by a single hydraulic groove while operating within the scope of the present disclosure.

The socket 50 includes an annular outer wall 68 that extends from an annular top surface 70 to an annular bottom surface 60. The socket 50 further includes a top wall 72. The top wall 72 is generally circular and extends across the central opening 74 formed by the annular outer wall 68. The top wall 72, in the embodiment shown in FIG. 4, is spaced below the annular top surface 70 to define a receiving area 76. As illustrated in FIG. 3, the receiving area receives a lower portion of the socket liner 48. Referring back to FIG. 4, the combination of the top wall 72 and the inner contact surface 78 defines a lower receiving cavity 80. When the socket 50 is installed on the top end of the main shaft 34, as is shown in FIG. 5, the top end 52 is received and retained within the receiving cavity defined by the socket 50.

Referring back to FIG. 4, both the upper hydraulic groove 64 and the lower hydraulic groove 66 are machined into the inner contact surface 78 of the socket 50. Both of the hydraulic grooves 64, 66 are continuous, annular grooves that are recessed from the inner contact surface 78.

As illustrated in FIG. 4, the lower hydraulic groove 66 is in fluid communication with a first hydraulic passageway 82 while the upper hydraulic groove 64 is in fluid communication with a second hydraulic passageway 84. In the embodiment shown, the first and second hydraulic passageways 82, 84 each provide a fluid communication pathway from the annular top surface 70 to the respective hydraulic groove. Alternatively, the first and second hydraulic passageways 82, 84 could exit through the bottom surface 60 or even exit through the outer cylindrical surface of the annular outer wall 68. The opening to the top surface 70 was found to be more convenient since the socket liner protects this area and needs to be removed prior to removing the socket 50.

Each of the first and second hydraulic passageways 82, 84 includes a vertical portion 86 and a lower portion 88. During formation of the socket 50, the vertical portion 86 is drilled into the annular outer wall 68 from the annular top surface 70. The interface between the vertical portion 86 and the top surface 70 includes a tap 90, shown in FIG. 5, which is specifically configured to receive a hydraulic fitting (not shown). The hydraulic fitting, in turn, receives a hydraulic supply line such that pressurized hydraulic fluid can be supplied to the first and second hydraulic passageways 82, 84.

Referring back to FIG. 4, the lower portion 88 of each of the hydraulic passageways is drilled upward at an angle into the inner contact surface 78. The angle of the lower portion 88 helps the machining tool to get to this area but the angle of the lower portion 88 is not required. The lower portion 88 passes through the vertical portion 86 such that the vertical portion 86 and the lower portion 88 define a continuous fluid passageway from the annular top surface 70 to the respective hydraulic groove 64 or 66.

Figure 6:
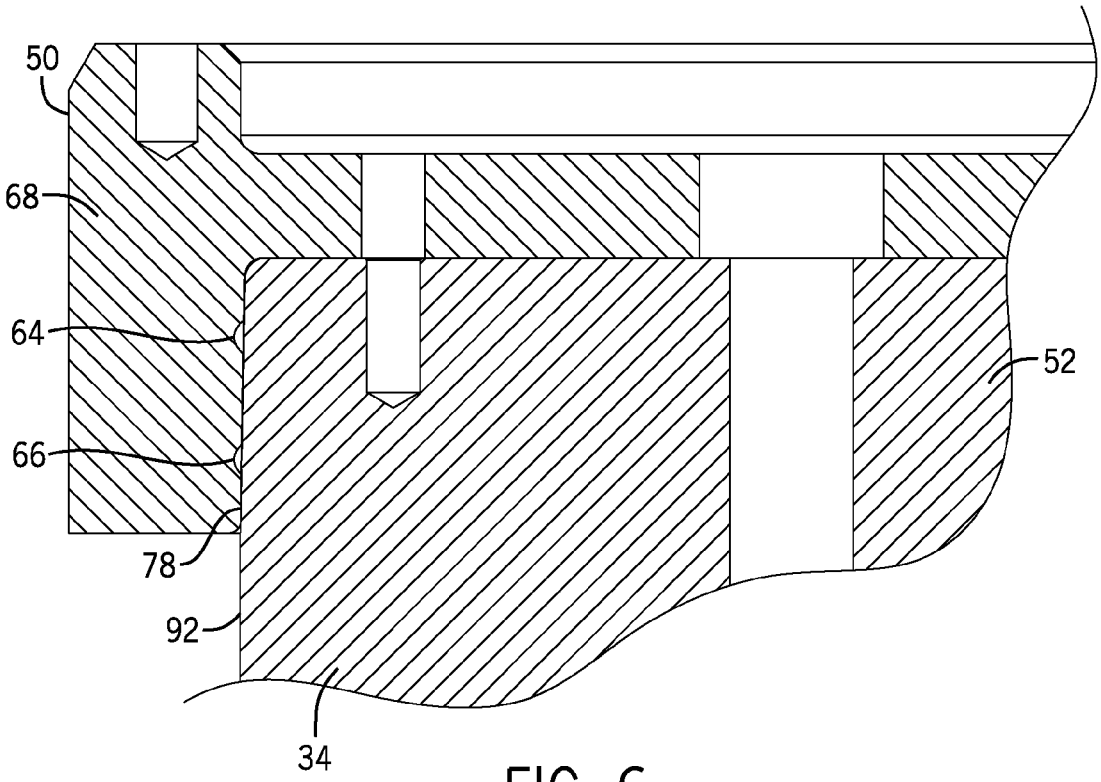
FIG. 6 is a magnified view illustrating the hydraulic grooves formed in the socket.

As illustrated in FIG. 6, when the socket 50 is installed onto the top end 52 of the main shaft 34, the first and second hydraulic grooves 64, 66 each define an open, fluid passageway between the outer surface 92 of the main shaft and the inner contact surface 78 of the socket 50.

As illustrated in FIG. 5, when it is desired to remove the socket 50 from the main shaft 34, the connectors 54 are initially loosened enough to allow the socket 50 to become fully disengaged from the main shaft but not removed. It is contemplated that the connectors 54 will be loosened, rather than completely removed, to prevent excess socket movement upon the application of pressurized hydraulic fluid, which could cause damage to the components.

After the connectors 54 are loosened, hydraulic fluid is supplied to both of the first and second hydraulic passageways 82, 84. As described previously, each of the hydraulic passageways 82, 84 includes a hydraulic fitting that is received at the annular top surface 70. Once pressurized hydraulic fluid is supplied to the hydraulic passageways 82, 84, the hydraulic fluid flows into the upper and lower hydraulic grooves 64, 66. When the hydraulic grooves 64, 66 are filled with oil, the circular grooves begin to build hydraulic pressure which creates a slight clearance between the inner contact surface 78 and the outer surface 92 of the main shaft 34. In this manner, the hydraulic fluid will essentially wedge the components apart, assuming that the hydraulic fluid pressure is greater than the fit contact pressure between the two components.

In addition to the hydraulic grooves 64 and 66, the hydraulic removal system can be designed such that both the socket 50 and the top end 52 of the main shaft 34 can include mating tapered contact surfaces. The mating tapered contact surfaces will aid in separating the socket 50 from the main shaft 34, as will be described below.

FIG. 7(*a*) is a magnified, partial section view that shows the taper formed in the inner contact surface 78 that includes both of the hydraulic grooves 64 and 66. In the preferred embodiment of the disclosure, the diameter of the receiving cavity 80 defined by the contact surface 78 and the top wall 72 decreases from the annular bottom surface 60 to the top wall 72. The taper angle A is approximately 1° relative to vertical.

FIG. 7(*b*) illustrates a magnified section view of the top end 52 of the main shaft 34. In the preferred embodiment of the disclosure, the outer diameter of the main shaft 34 decreases in at least a portion of the top end 52 that is received by the receiving cavity of the socket. The tapered top end 52 defines a taper angle B relative to the vertical axis 94. The taper angle B is approximately 1° relative to vertical. The taper angles A and B do not need to match each other and can vary depending upon design requirements, which may influence fit contact pressure.

Figure 7A:
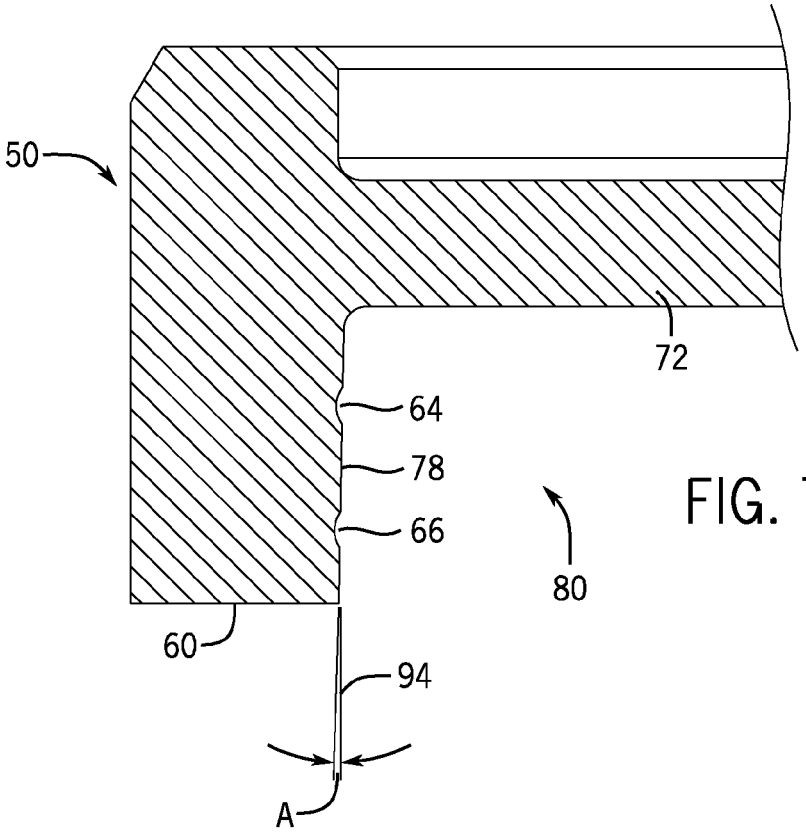
FIG. 7(*a*) is a magnified, partial section view of the socket showing the tapered inner contact surface.
Figure 7B:
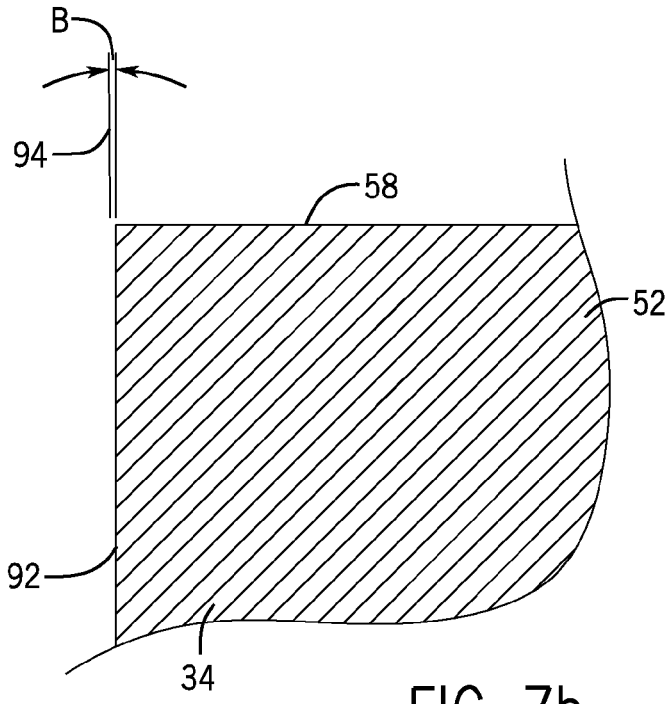

As can be understood by the drawings in FIGS. 7*a* and 7*b*, the tapered inner contact surface 78 formed on the socket 50 as well as the tapered outer surface 92 formed at the top end 52 of the main shaft 34 decrease the amount of interference present between the socket 50 and the main shaft 34 as the socket 50 is lifted up and away from the top end 52 of the main shaft 34. The taper allows the components to separate much sooner as the socket lifts away from the main shaft.

Referring back now to FIGS. 5 and 6, when the hydraulic pressure of the fluid contained within the upper and lower hydraulic grooves 64, 66 exceeds the fit contact pressure between the socket 50 and the main shaft 34, the hydraulic pressure, along with the tapered mating surfaces, will create opposing vertical forces on each of the components such that the socket will "pop" or "jump" upward away from the stationary main shaft 34. As indicated previously, the loosening of the connectors 54 will be used as a stop to limit the separation between the socket 50 and the main shaft 34.

In the embodiment shown in FIGS. 5 and 6, the two separate hydraulic grooves 64 and 66 are fed with pressurized hydraulic fluid. It is contemplated that each of the hydraulic grooves may require a different amount of hydraulic pressure to aid in the separation of the socket 50 from the main shaft 34. One way to achieve the different hydraulic pressures is to split the flow of the hydraulic fluid after the pressure source and position needle valves in each hydraulic supply line to the separate hydraulic passageways 82, 84. The needle valves allow maintenance personnel to vary the pressure at each of the hydraulic grooves to further aid in separation of the socket 50 from the main shaft 34. Additionally, if one of the hydraulic grooves 64 or 66 is leaking and not allowing pressure to build up in the other groove, the supply of fluid to the leaking groove can be reduced or shut off allowing the other groove to build pressure again.

Although the hydraulic grooves 64 and 66 are shown as having a machined curved back surface, an alternate embodiment could include rectangular shaped hydraulic grooves or other desired shapes. Additionally, the number of hydraulic grooves could be modified to be either one or three or more depending upon the actual design.

In another contemplated, alternate design, the socket 50 could be designed having a cylindrical inner contact surface 78 while the main shaft 34 included the tapered outer surface 92 shown in FIG. 7(*b*). Likewise, the outer surface 92 of the main shaft 34 could be designed having a constant outer diameter while the socket 50 shown in FIG. 7(*a*) could include the tapered inner contact surface 78.

In yet another contemplated, alternate design, sealing rings, such as an O-ring, could be positioned on one or both sides of the hydraulic grooves 64, 66 shown in FIG. 7(*a*). The use of sealing rings on one or both sides of the hydraulic grooves would prevent the leakage of hydraulic fluid past the sealing ring. The use of sealing rings may aid in increasing the hydraulic pressure that can be built up between the socket 50 and the main shaft 34 by eliminating leakage. In an embodiment in which sealing rings are used, it is contemplated that sealing ring grooves would be machined into the contact surface 78 of the socket 50, one above the upper hydraulic groove 64 and one below the lower hydraulic groove 66.

Figure 8:
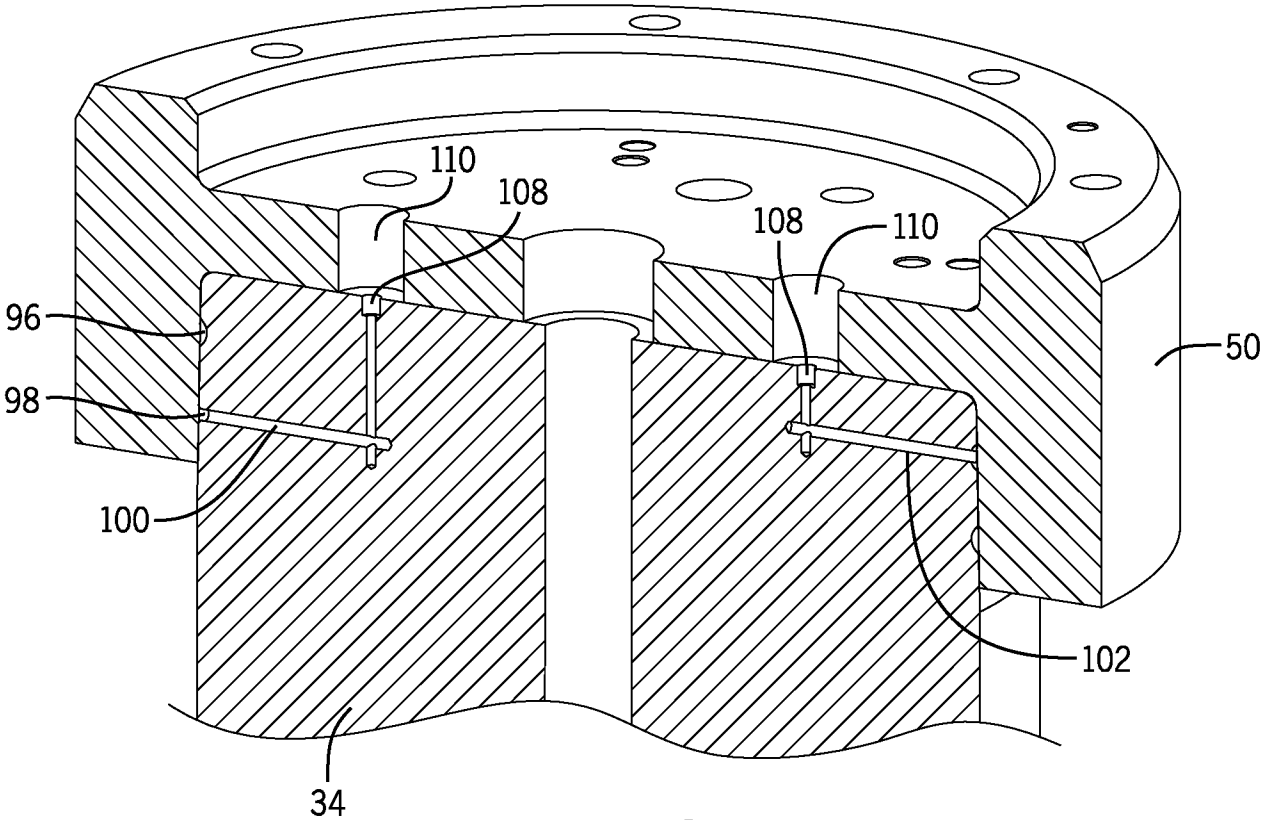
FIG. 8 is a section view of an alternate embodiment of the socket and main shaft.

FIGS. 8-10 illustrate a contemplated, alternate design for the hydraulic removal system in which the hydraulic grooves are removed from the socket 50, as shown in the first embodiment of FIGS. 5-7, and instead are included in the outer surface of the main shaft 34. As illustrated in FIG. 9, the tapered top end 52 of the main shaft 34 is machined to include the upper hydraulic groove 96 and the lower hydraulic groove 98 recessed from the outer surface 92. Referring to FIG. 10, the lower hydraulic groove 98 is in fluid communication with a first hydraulic passageway 100 while the upper hydraulic groove 96 is in fluid communication with the second hydraulic passageway 102. Each of the hydraulic passageways 100, 102 includes a vertical portion 104 and a lower portion 106. The vertical portion 104 is drilled into the top surface 58 of the main shaft 34 and includes a tap 108 that is designed to receive a hydraulic fitting.

Referring back to FIG. 8, the socket 50 is designed to include a pair of access openings 110 that are each aligned with the access point of the respective first and second hydraulic passageways 100, 102, and specifically the tap 108. In this manner, a hydraulic fitting can be inserted into the tap 108 when the socket 50 is installed as shown in FIG. 8.

Figure 11:
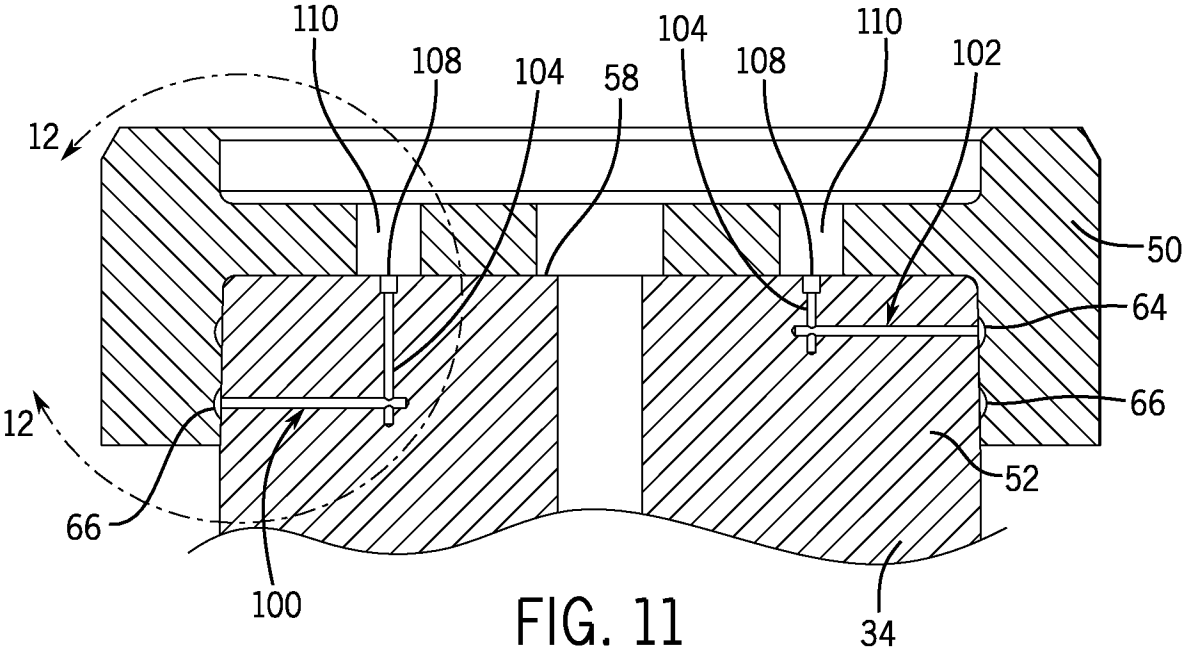
FIG. 11 is a section view of another alternate embodiment of the socket and top end of the main shaft.
Figure 13:
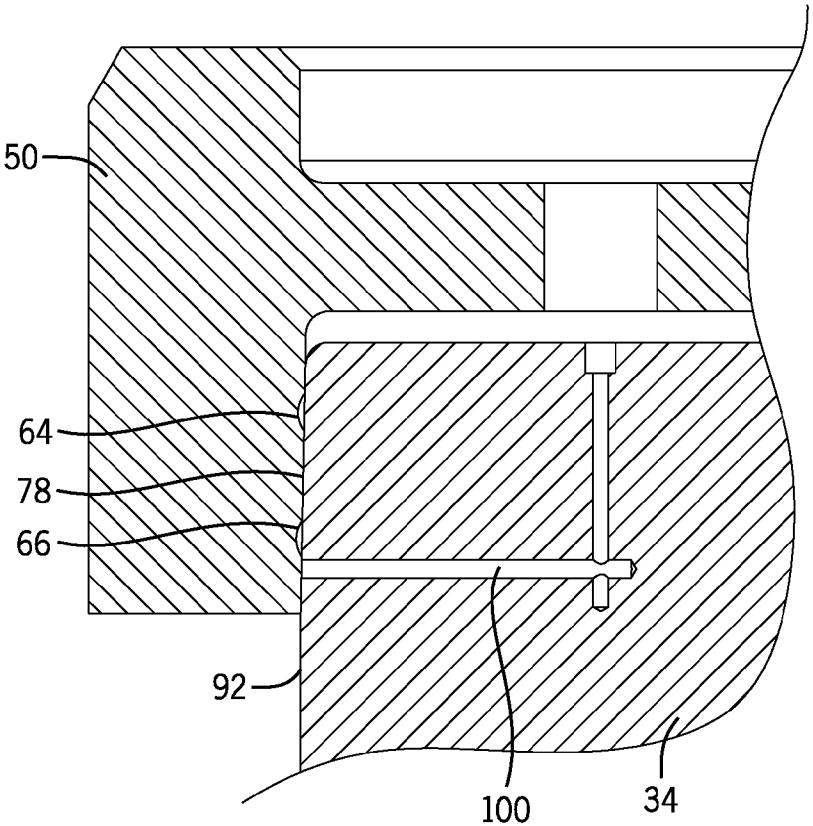
FIG. 13 is a section view similar to FIG. 12 illustrating the movement of the socket relative to the top end of the main shaft.
Figure 12:
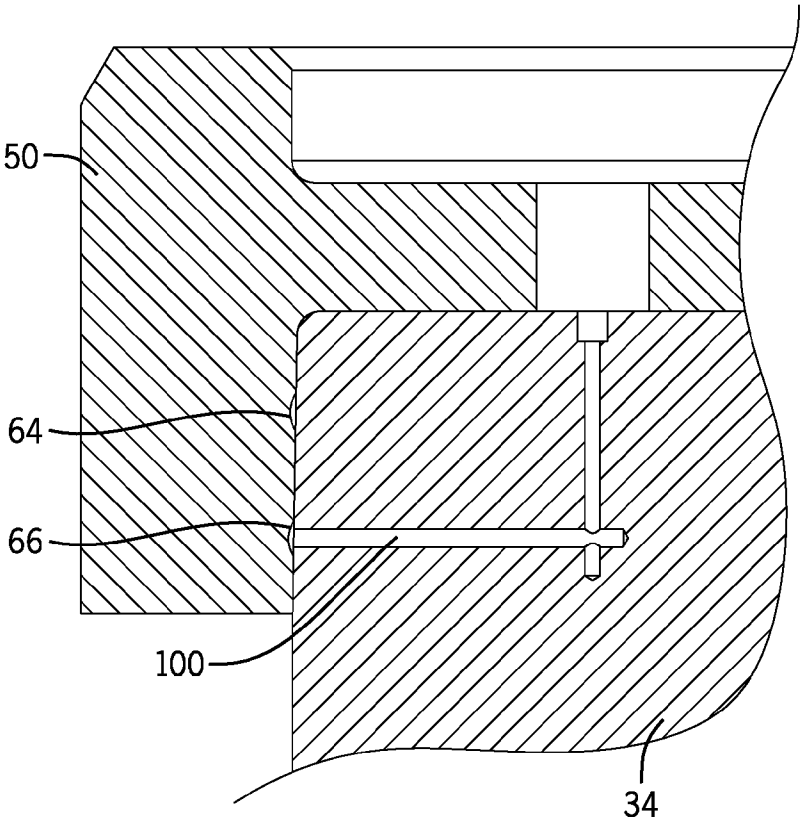
FIG. 12 is a magnified view taken along line 12-12 of FIG. 11.

FIGS. 11-13 illustrate yet another alternate, contemplated embodiment of the hydraulic removal system of the present disclosure. In the embodiment shown in FIGS. 11-13, the socket 50 is formed with the upper hydraulic groove 64 and the lower hydraulic groove 66. Unlike the first embodiment shown in FIGS. 5-7, the hydraulic passageways are formed in the main shaft 34. Specifically, the first hydraulic passage 100 is formed in the top end 52 of the main shaft 34 and is in fluid communication with the lower hydraulic groove 66. The second hydraulic passageway 102 is formed in the main shaft 34 and is in fluid communication with the upper hydraulic groove 64 formed in the socket 50. The first and second hydraulic passageways 100, 102 each include a vertical passageway 104 and a tap 108 formed in the top surface 58 of the main shaft. The socket 50 is designed including the pair of access openings 110 that allow a hydraulic supply line to feed hydraulic fluid to each of the first and second hydraulic passageways 100, 102.

As illustrated in FIG. 12, when the socket 50 is completely assembled onto the main shaft 34, the lower portion of the first hydraulic passageway 100 is directly aligned with the lower hydraulic groove 66 formed in the socket 50. Likewise, the lower portion of the second hydraulic passageway (not shown) is aligned with the upper hydraulic groove 64.

When the socket 50 is removed from the main shaft 34, as shown in FIG. 13, the lower hydraulic groove 66 moves upward and out of alignment with the first hydraulic passageway 100. Only when the socket 50 is completely installed onto the main shaft 34, as shown in FIG. 12, is the first hydraulic passageway 100 in alignment with the lower hydraulic groove 66.

In yet another contemplated embodiment, not shown, the annular grooves could be formed in the main shaft 34 and the hydraulic passageways could be formed in the socket 50.

Although the hydraulic removal system of the present disclosure is designed to remove the socket 50 from the main shaft 34, it is contemplated that the prior art method that includes heating of the socket 50 and the use of jackscrews could be utilized to separate the socket 50 and the main shaft 34 if something was wrong with the hydraulic removal system such that it could not operate. It is also contemplated that heat could be used with the hydraulic system if for some reason the hydraulic system alone was not sufficient to push off the socket by itself.

The hydraulic removal system shown and described in the drawing Figures can include both hydraulic grooves formed between the socket and the main shaft as well as mating, tapered surfaces formed on one or both of the socket and the main shaft. Although a combination of the hydraulic grooves and the tapered mating surfaces are contemplated as being the most effective method and system for removing the socket from the main shaft, it is contemplated that the hydraulic removal system could eliminate the tapered contact surfaces formed between the socket and the main shaft. In such an embodiment, the pressurized hydraulic fluid contained within the hydraulic grooves would aid in the separation process of the socket from the main shaft but additional mechanical pullers of jackscrews would be needed to separate the two cylinder faces. However, it is contemplated that utilizing both the hydraulic grooves and the tapered, mating contact surfaces will greatly facilitate the separation of the socket from the main shaft.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A gyrational crusher, comprising:

a stationary bowl;

a head assembly positioned for movement within the stationary bowl to create a crushing gap between the stationary bowl and the head assembly;

a main shaft having a top end and an outer surface, wherein the head assembly gyrates relative to the main shaft;

an eccentric rotatable about the main shaft to impart gyrational movement to the head assembly within the bowl;

a socket mounted to the top end of the main shaft; and at least one hydraulic groove positioned between the socket and the mainshaft and operable to separate the socket from the top end of the main shaft.

2. The crusher of claim 1 wherein the socket comprises an annular outer wall having an inner contact surface and extending between an annular bottom surface and an annular top surface and a circular top wall, wherein the main shaft is received within a receiving cavity defined by the inner contact surface and the top support wall.

3. A gyrational crusher, comprising:

a stationary bowl;

a head assembly positioned for movement within the stationary bowl to create a crushing gap between the stationary bowl and the head assembly;

a main shaft having a top end and an outer surface, wherein the head assembly gyrates relative to the main shaft;

an eccentric rotatable about the main shaft to impart gyrational movement to the head assembly within the bowl;

a socket mounted to the top end of the main shaft, wherein the socket comprises an annular outer wall having an inner contact surface and extending between an annular bottom surface and an annular top surface and a circular top wall, wherein the main shaft is received within a receiving cavity defined by the inner contact surface and the top support wall; and a hydraulic separation system operable to separate the socket from the top end of the main shaft, wherein the hydraulic separation system includes at least one hydraulic groove formed in the inner contact surface of the socket.

4. The crusher of claim 3 further comprising a hydraulic supply passageway extending through the annular outer wall from the annular top surface to the hydraulic groove.

5. The crusher of claim 3 wherein the inner contact surface of the socket includes a plurality of hydraulic grooves.

6. The crusher of claim 5 further comprising a plurality of hydraulic supply passageways each extending through the annular outer wall to one of the plurality of hydraulic grooves.

7. The crusher of claim 3 wherein the hydraulic separation system includes at least one hydraulic groove formed in the outer surface of the main shaft.

8. The crusher of claim 7 further comprising a hydraulic supply passageway extending through the main shaft from the top end to the hydraulic groove.

9. The crusher of claim 7 wherein the top end of the main shaft includes a plurality of hydraulic grooves.

10. The crusher of claim 9 further comprising a plurality of hydraulic supply passageways each extending through the main shaft from the top end of the main shaft to one of the plurality of hydraulic grooves.

11. The crusher of claim 3 wherein the outer surface of the main shaft is tapered and increases in diameter from the top end to a location below the top end and the inner contact surface of the socket is tapered and decreases in diameter from the bottom surface to the circular top support wall.

12. A gyrational crusher comprising:

a head assembly positioned for movement within a stationary bowl;

an eccentric rotatable about a main shaft to impart gyrational movement to the head assembly within the bowl, the main shaft having an outer surface and a top end;

a socket including an annular outer wall extending from an annular top surface to an annular bottom surface and a top wall, wherein the annular outer wall and the top support wall define a receiving cavity that receives the top end of the main shaft;

at least one hydraulic groove formed between the main shaft and the socket; and at least one hydraulic supply passageway in fluid communication with the hydraulic groove to supply pressurized hydraulic fluid to the hydraulic groove.

13. The gyrational crusher of claim 12 wherein the hydraulic groove is formed in an inner contact surface formed on the annular outer wall of the socket.

14. The gyrational crusher of claim 13 wherein the hydraulic supply passageway extends through the annular outer wall of the socket.

15. The gyrational crusher of claim 12 wherein the hydraulic groove is formed in the outer surface of the main shaft near the top end.

16. The gyrational crusher of claim 15 wherein the hydraulic supply passageway extends through the main shaft.

17. The gyrational crusher of claim 12 wherein a portion of the outer surface of the main shaft is tapered and an inner contact surface of the socket is tapered from the annular bottom surface to the top support wall.

18. The gyrational crusher of claim 13 wherein the socket includes a plurality of hydraulic grooves.

19. The gyrational crusher of claim 15 wherein the main shaft includes a plurality of hydraulic grooves.

* * * * *